US009402438B2

(12) United States Patent
Shakoor et al.

(10) Patent No.: US 9,402,438 B2
(45) Date of Patent: Aug. 2, 2016

(54) JOINT LOAD REDUCING FOOTWEAR

(75) Inventors: Najia Shakoor, Hinsdale, IL (US); Roy H. Lidtke, Elberon, IA (US)

(73) Assignee: Rush University Medical Center, Chicago, IL (US)

( * ) Notice: Subject to any disclaimer, the term of this patent is extended or adjusted under 35 U.S.C. 154(b) by 659 days.

(21) Appl. No.: 13/152,401

(22) Filed: Jun. 3, 2011

(65) Prior Publication Data

US 2011/0232133 A1 Sep. 29, 2011

Related U.S. Application Data

(63) Continuation-in-part of application No. 11/861,745, filed on Sep. 26, 2007, now Pat. No. 7,954,261.

(60) Provisional application No. 60/827,168, filed on Sep. 27, 2006.

(51) Int. Cl.
*A43B 13/14* (2006.01)
*A43B 3/00* (2006.01)

(52) U.S. Cl.
CPC ..... *A43B 13/141* (2013.01); *A43B 3/0036* (2013.01)

(58) Field of Classification Search
CPC ..... A43B 3/0036; A43B 13/00; A43B 13/14; A43B 13/141
USPC ..... 36/25 R, 31, 59 C, 88, 102, 103
See application file for complete search history.

(56) References Cited

U.S. PATENT DOCUMENTS

| | | | | |
|---|---|---|---|---|
| 4,562,651 | A | 1/1986 | Frederick et al. | |
| 4,785,557 | A * | 11/1988 | Kelley et al. | 36/32 R |
| 4,827,631 | A | 5/1989 | Thornton | |
| 5,012,597 | A * | 5/1991 | Thomasson | 36/59 C |
| 5,384,973 | A | 1/1995 | Lyden | |
| 5,678,327 | A | 10/1997 | Halberstadt | |
| 5,906,872 | A * | 5/1999 | Lyden et al. | 428/52 |
| 6,021,588 | A | 2/2000 | Alviso | |
| 6,341,432 | B1 | 1/2002 | Muller | |
| 6,643,956 | B2 | 11/2003 | Mawusi et al. | |
| 6,725,578 | B2 | 4/2004 | Kerrigan | |
| 6,729,046 | B2 | 5/2004 | Ellis, III | |
| 6,782,639 | B1 | 8/2004 | Muller | |
| 6,789,331 | B1 | 9/2004 | Ellis, III | |
| 6,810,606 | B1 | 11/2004 | Ellis, III | |
| 6,918,197 | B2 | 7/2005 | Ellis, III | |

(Continued)

FOREIGN PATENT DOCUMENTS

| | | |
|---|---|---|
| DE | 29919124 U1 | 2/2000 |
| EP | 0857434 | 8/1998 |

(Continued)

OTHER PUBLICATIONS

Office Action issued in application No. JP 2009-530587 (2012).

(Continued)

*Primary Examiner* — Khoa Huynh
*Assistant Examiner* — Sharon M Prange
(74) *Attorney, Agent, or Firm* — Barnes & Thornburg LLP; Alice O. Martin

(57) ABSTRACT

Footwear including a flexible sole having a series of flexure zones positioned to correspond to primary joint axes of the human foot approximating the characteristics of a bare foot in motion.

14 Claims, 7 Drawing Sheets

(56) References Cited

U.S. PATENT DOCUMENTS

| | | | | |
|---|---|---|---|---|
| 6,948,262 | B2 | 9/2005 | Kerrigan | |
| 6,990,755 | B2 | 1/2006 | Hatfield et al. | |
| D527,172 | S * | 8/2006 | Burg | D2/959 |
| 2004/0045196 | A1 * | 3/2004 | Shepherd | 36/114 |
| 2004/0221487 | A1 | 11/2004 | Fried | |
| 2005/0076536 | A1 | 4/2005 | Hatfield et al. | |
| 2007/0039209 | A1 | 2/2007 | White et al. | |

FOREIGN PATENT DOCUMENTS

| | | |
|---|---|---|
| JP | 60-195507 U | 12/1985 |
| JP | 08-164002 | 6/1996 |
| JP | 2003-284605 | 10/2003 |
| JP | 2006-247208 | 9/2006 |
| WO | WO 2005/034670 | 4/2005 |

OTHER PUBLICATIONS http://www.nike.com/nikefree/usa/index.jhtml (2006).

Altman et al., "Development of criteria for the classification and reporting of osteoarthritis. Classification of osteoarthritis of the knee. Diagnostic and Therapeutic Criteria Committee of the American Rheumatism Association," *Arthritis Rheum*., 29 (8): 1039-1049 (1986).

Altman et al., "Atlas of individual radiographic features in osteoarthritis," *Osteoarthritis Cartilage*, 3 (Suppl. A): 3-70 (1995).

Andriacchi et al., "*Musculoskeletal Dynamics, Locomotion, and Clinical Applications*," Lippincott-Raven Publishers, Philadelphia, 37-68 (1997).

Bellamy et al., "Validation study of WOMAC: a health status instrument for measuring clinically important patient relevant outcomes to antiheumatic drug therapy in patient with osteoarthritis of the hip or knee," *J. Rheumatol*., 15 (12): 1833-1840 (1988).

Bergmann et al., "Influence of shoes and heel strike on the loading of the hip joint," *J. Biomech*., 28 (7): 817-827 (1995).

Felson et al., "The incidence and natural history of knee osteoarthritis in the elderly The Framingham Osteoarthritis Study," *Arthritis Rheum*., 38 (10): 1500-1505 (1995).

Hurwitz et al., "Knee pain and joint loading in subject with osteoarthritis of the knee," *J. Ortho. Res*., 18 (4): 572-579 (2000).

Kerrigan et al., "Effectiveness of a lateral-wedge insole on knee varus torque in patients with knee osteoarthritis," *Arch Phys. Med. Rehabil*., 83 (7): 889-893 (2002).

Kerrigan et al., "Men's shoes and nee joint torques relevant to the development and progression of knee osteoarthritis," *J. Rheumatol*., 30 (3): 529-533 (2003).

Kerrigan et al., "Moderate-heeled shoes and knee joint torques relevant to the development and progression of knee osteoarthritis," *Arch Phys. Med. Rehabil*., 86 (5): 871-875 (2005).

Miyazaki et al., "Dynamic load at baseline can predict radiographic disease progression in medial compartment knee osteoarthritis," *Ann. Rheum. Dis*., 61 (7): 617-622 (2002).

Moisio et al., "Normalization of joint movements during gait: a comparison of two techniques," *J. Biomech*., 36 (4): 599-603 (2003).

Mundermann et al., "Potential strategies to reduce medial compartment loading in patients with knee osteoarthritis of varying severity: reduced walking speed," *Arthritis Rheum*., 50 (4): 1172-1178 (2004).

Pham et al., "Laterally elevated wedged insoles in the treatment of medial knee osteoarthritis. A two-year prospective randomized controlled study," *Osteoarthritis Cartilage*, 12 (1): 46-55 (2004).

Sharma et al., "Knee adduction moment, serum hyaluronan level, and disease severity in medial tibiofemoral osteoarthritis," *Arthritis Rheum*., 41 (7): 1233-1240 (1998).

International Search Report issued in application No. PCT/US07/79617 (2008).

Office Action issued in EP App. No. 07843278.8 (2013).

* cited by examiner

JOINT LOAD REDUCING FOOTWEAR

This application is a continuation-in-part of Shakoor et al. U.S. application Ser. No. 11/861,745, entitled "Joint Load Reducing Footwear," which claims priority to U.S. provisional patent application Ser. No. 60/827,168 filed Sep. 27, 2006, the disclosures of which are hereby incorporated by reference in their entireties.

The U.S. Government has a paid-up license in this invention and the right in limited circumstances to require the patent owner to license others on reasonable terms as provided for by the terms of Grant No. 1P50 AR048941 awarded by the National Institutes of Health, Department of Health and Human Services.

BACKGROUND

The present disclosure relates to footwear that results in reduced joint loading compared to common walking shoes currently available. In particular, the present disclosure relates to footwear having a flexible sole with a series of flexure zones positioned to correspond to primary joint axes. The footwear of the present disclosure thus approximates the characteristics of a bare foot in motion.

Osteoarthritis (OA) of the lower extremity in humans is related to aberrant biomechanical forces. Dynamic joint loading is an important factor in the pathophysiology of OA of the knee. The prevalence and progression of knee OA are reported to be associated with high dynamic loading. One standard parameter assessed as a marker of dynamic knee loading is the external knee adduction moment, a varus torque on the knee that reflects the magnitude of medial compartment joint loading. This moment is considered to be important because nearly seventy percent of knee OA affects the medial tibiofemoral compartment of the knee. The peak external knee adduction moment has been reported to correlate both with the severity and with the progression of knee OA. Consequently, strategies that effectively reduce loads on the knee during gait would be useful.

Biomechanical interventions aimed at reducing medial compartment loading, such as lateral wedge shoe orthotics have been investigated as therapeutic options. Insertion of lateral wedge orthotics into regular shoes can induce significant decreases in knee moments by up to 5% to 7%, in subjects with medial compartment knee OA. Furthermore, since the lower extremity joints are interrelated, alterations of mechanics at the foot, may not only affect knee loads but may have consequences at the other lower extremity joints.

Loading at the knees may be affected by altering the ground reaction force. The ground reaction force is the upward force exerted on a human body from the ground in opposition to the force of gravity. It is equal and opposite to the force the human body exerts through the foot on the ground. Because ground reaction forces are transmitted through the feet, such forces are influenced by footwear.

Prior studies of the effects of footwear on joint loading have been restricted to control subjects without OA, and have demonstrated that even moderate-heeled shoes increase peak knee torques. In addition, one study suggested that common walking shoes may result in increased knee loads in normal individuals, but these effects were attributed to differences in walking speeds while wearing shoes. One study evaluated hip loads in a patient who had an instrumented prosthesis inserted at the time of joint replacement for hip OA. The instrumented prosthesis included a force transducer for obtaining force measurements. By obtaining direct force measurements from the force transducer of the prosthesis, the investigators were able to demonstrate that there were no differences in hip loads among nearly 15 different types of shoes, but the hip loads were lower when the subject was barefoot compared to any of the footwear.

Walking barefoot significantly decreases the peak external knee adduction moment compared to walking with common walking shoes. An 11.9% reduction was noted in the external knee adduction moment during barefoot walking. Reduction in loads at the hip were also observed. Stride, cadence, and range of motion at the lower extremity joints also changed significantly but these changes could not explain the reduction in the peak joint loads.

Common shoes detrimentally increase loads on the lower extremity joints. Therefore, it is desirable to mitigate factors responsible for the differences in loads between footwear and barefoot walking as applied to common shoes and walking practices to reduce prevalence and progression of OA.

SUMMARY

The present disclosure relates to footwear that simulates the motions, force applications and proprioceptive feedback of the natural foot for the express purpose of reducing the moments of force across lower extremity joint segments. The footwear allows for changing centers of rotations around the mobile joint axis in each of the lower extremity joints and reduces the effect that the footwear has on influencing these forces compared to common walking shoes.

The present disclosure relates to footwear having a sole that incorporates the essential unloading characteristics of barefoot walking. Barefoot walking reduces knee loading in normal healthy individuals as well as in individuals with OA. Therefore it is desirable to develop footwear that approximates the characteristics of barefoot walking, and thus reduces joint loads, compared to common walking shoes.

Shoes have three primary components, the upper, the outsole and the midsole. The upper is comprised of materials of various flexibility that wrap around the foot superiorly. The upper includes the vamp, covering the instep and toes, heel counter around the back of the heel, toe box, tongue and foxing (extra-pieces). The midsole includes materials of various thickness and stiffness that connect the upper and the outsole. The outsole is connected to the midsole and is the most inferior portion of the shoe that comes in contact with the ground and is therefore made of various materials designed for resiliency.

The disclosed footwear allows for point application of the ground reactive force vector on the various footwear components, thereby reducing the ability of the footwear to transfer these external forces from one joint segment to the next along the leg (i.e. from foot to knee to hip). This is accomplished by having a thin flexible sole with flexure zones positioned therein to match the natural motion lines of the human foot, and thereby during walking, orienting the force vectors in the lower extremities in the same direction as they are in barefoot walking. The physiological effect includes alterations in the forces, pressures, and positions, of the lower extremity during the gait cycle and therefore produces proprioceptive and neuromuscular changes within the wearer.

In an embodiment of the disclosed footwear, the outsole and midsole are modified compared to existing shoes in that the thickness and properties of the sole material allow for motion around the primary joint axis of the lower extremity proximal to the weight bearing surface. In several prototypes this was achieved simply by removing some of the outsole and midsole material, forming grooves corresponding to the natural motion lines of the human foot. However, any modification that will allow for the remaining segments of the outsole and midsole of the footwear to redirect, or be allowed to move in response to, application of the force vector can be utilized. Also, a rounded heel is provided to contour the natural human heel.

BRIEF DESCRIPTION OF THE DRAWINGS

The present disclosure will be described hereafter with reference to the attached drawings which are given as non-limiting examples only, in which.

DETAILED DESCRIPTION

Figure 1:
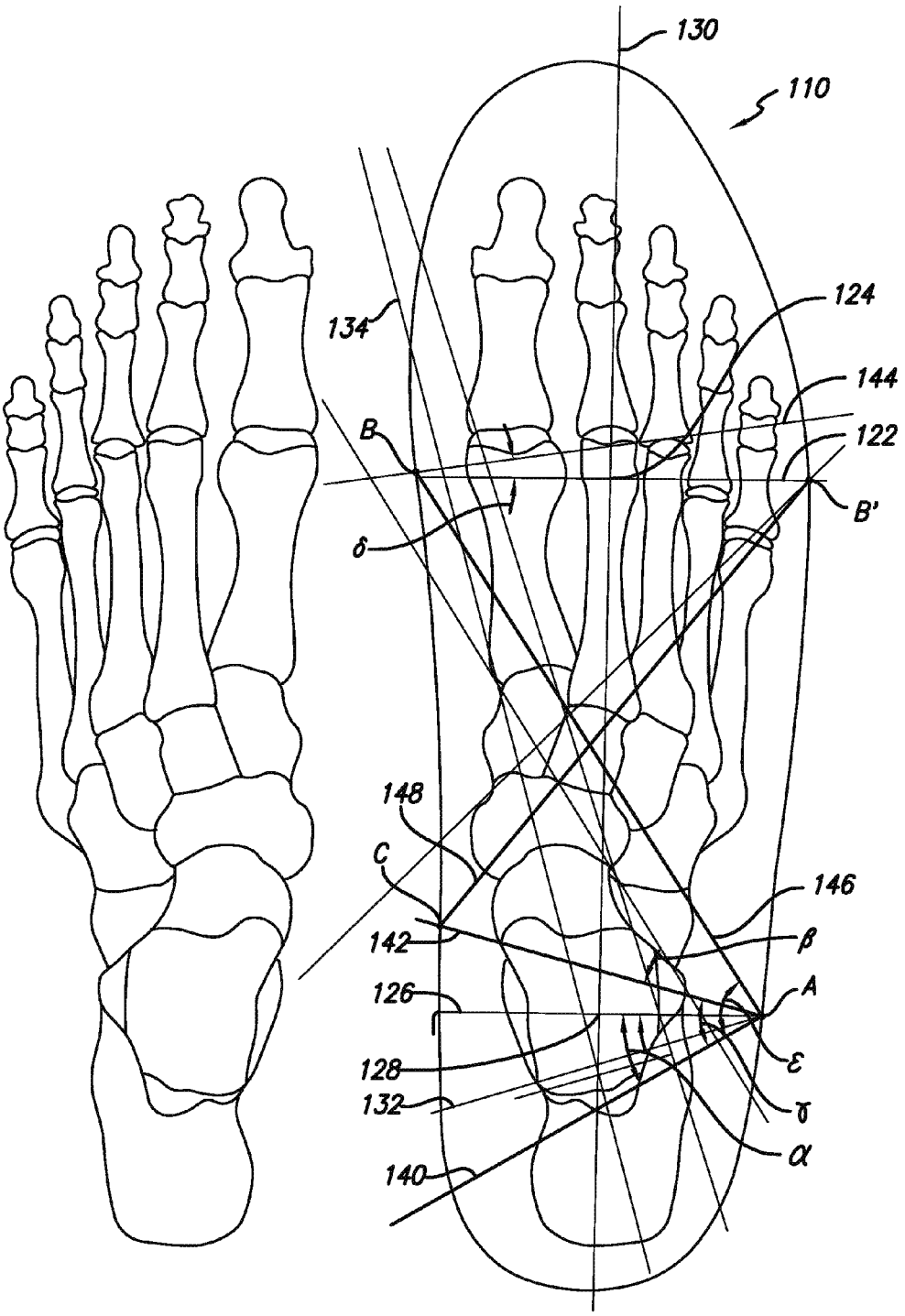
FIG. 1 is a plan view representation of a foot and a sole having flexure zones corresponding to primary joint axes of the human foot to approximate the characteristics of a bare foot.

While the present disclosure may be susceptible to embodiment in different forms, there is shown in the drawings, and herein will be described in detail, embodiments with the understanding that the present description is to be considered an exemplification of the principles of the disclosure and is not intended to be exhaustive or to limit the disclosure to the details of construction and the arrangements of components set forth in the following description or illustrated in the drawings.

The present disclosure relates to footwear having a flexible sole 110 with a number of flexure zones, or lines of reduced rigidity, that allow the sole 110 to flex more like the natural human foot during barefoot walking. These flexure zones are configured to be aligned with the primary joint axes of the human foot resulting in a sole 110 that flexes similar to a natural foot.

In an embodiment of the present disclosure, the outsole and midsole have grooves configured to approximate the properties of the primary joint axis of the lower extremity proximal to the weight bearing surface. In several prototypes this was achieved simply by removing some of the outsole and midsole material. However, any construction that allows for the segments of the outsole and midsole to move away from the direction of the application of the force vector can be utilized. For example, it is envisioned that the sole 110 of the present disclosure may be constructed from an integral piece of molded material such as rubber, ethylene vinyl acetate (EVA), polyurethane, neoprene, or other suitable material. A mold may have incorporated grooves to produce the sole, or the grooves may be cut into the material after forming. Another example may include a sole of composite material, wherein the flexure zones are formed from a less rigid material than the surrounding outsole.

The locations of the flexure zones were determined by starting with the anatomical locations of the proximal joint axis and widening the area to allow for the dynamic changes in the rotational centers of the joint axis during gait. Referring to FIG. 1, a first reference line called the base of forefoot 122 is determined by measuring and establishing the widest part of the weight bearing surface of the forefoot from the plantar surface of the sole. The midpoint 124 of the base of forefoot 122 is determined by dividing the width of the base of forefoot 122 in half.

Similarly, a second reference line called the base of heel 126 is determined by measuring and establishing the widest part of the hindfoot. The midpoint 128 of the base of heel 126 is determined by dividing the width of the base of heel in half.

A third reference line called the longitudinal axis of the foot 130 is determined by drawing a line through the midpoints 124, 128 of the base of forefoot 122 and base of heel 126, respectively.

A first flexure zone 140 is positioned within the sole 110 along a line from an apex A at the lateral edge of the base of heel 126, and oriented at an angle $\alpha$, which is 30 degrees posterior to the base of heel. The configuration for the first flexure zone 140 is determined by establishing the ground reaction force vector position at heel strike, the instant that the heel strikes the ground. The subtalar joint is 16 degrees externally rotated, the leg is approximately 12 degrees externally rotated and, depending on the walking speed, the lower leg strikes the ground in a 2-5 degree varus position. In order for the sole of a shoe not to produce a larger lever arm on the subtalar joint axis 132, a line perpendicular to the subtalar joint axis 134 was established and the added effect of the varus position of the subject's leg at heel strike combined with an externally rotated leg produces a measured line approximately 30 degrees posteriorly rotated to the heel coronal (frontal) plane bisection of the heel (base of heel 126).

Using the lateral edge of the base of heel 126 as an apex A, a second flexure zone 142 is positioned within the sole 110 at an angle $\beta$, which is approximately 15 degrees anterior to the base of heel 126. First flexure zone 140 and second flexure zone 142 are thus oriented to form an angle $\gamma$ of approximately 45 degrees. Second flexure zone 142 is positioned collinear with a line representing the transverse plane projection of the ankle joint axis onto the plantar sole.

From an apex B at the medial base of the forefoot 122, a third flexure zone 144 is positioned within the sole 110 at an angle $\delta$ which is approximately 10 degrees anterior to the base of the forefoot 122. Third flexure zone 144 is thus positioned collinear with a line representing the axis of the first metatarsal phalangeal joint during propulsion in an externally rotated abducted foot.

A fourth flexure zone 146 is positioned within the sole 110 from apex A extending from the lateral edge of the base of the heel 126 to apex B at the medial edge of the base of the forefoot 122. Fourth flexure zone 146 is thus positioned collinear with a line representing a transverse plane projection of the oblique axis of the midtarsal joint. Fourth flexure zone 146 and first flexure zone 140 are oriented to form an angle $\epsilon$ which is approximately 90 degrees.

A fifth flexure zone 148 is positioned within the sole 110 extending from apex B' at the lateral edge of the base of the forefoot 122 to apex C at the medial edge of the second flexure zone 142. Fifth flexure zone 148 is positioned collinear with a line representing the transverse plane projection of the first ray (medial column) and will intersect the longitudinal axis 130 of the foot at approximately 45 degrees.

The flexure zones, as discussed in detail with respect to FIG. 1, have been specifically located based on an optimized angle to the joint axis when the proximal joint plays a role in the gait cycle and the understanding of location, position, and magnitude of the ground reaction force vector during each time period. The flexure zones are located to achieve a solution that provides an optimum benefit for as many people as possible.

In one embodiment, the physical properties of the material between the flexure zones may be manipulated to enhance the effects of the flexure zones. In one example, the material to the outside of the sole in the area formed by the flexure zones 146 and 148 and/or the material below the flexure zone 140 may be more rigid or denser than other areas of the sole. In another example, the material to the inside of the sole in the area formed by the flexure zones 146 and 148 may be less rigid and formed with less material than other areas of the sole. Any number of different combinations of materials between the various flexure zones may be utilized.

The human foot has numerous proprioceptive receptors for detecting stimuli such as motion and/or position and responding to the stimuli. An embodiment of the sole 110 of the present disclosure is made of either ethylene vinyl acetate (EVA) or polyurethane and is approximately 0.25 inches thick. While providing flexion corresponding to the natural motion lines of the human foot, the sole 110 must be of sufficient thickness to provide protection to the foot over numerous encountered walking surfaces. However, the sole 110 must also be thin enough to provide adequate proprioceptive input to the foot. In addition to a flat bottom, the sole of the present disclosure has a rounded heel without any flaring to contour the natural heel.

Figure 2B:
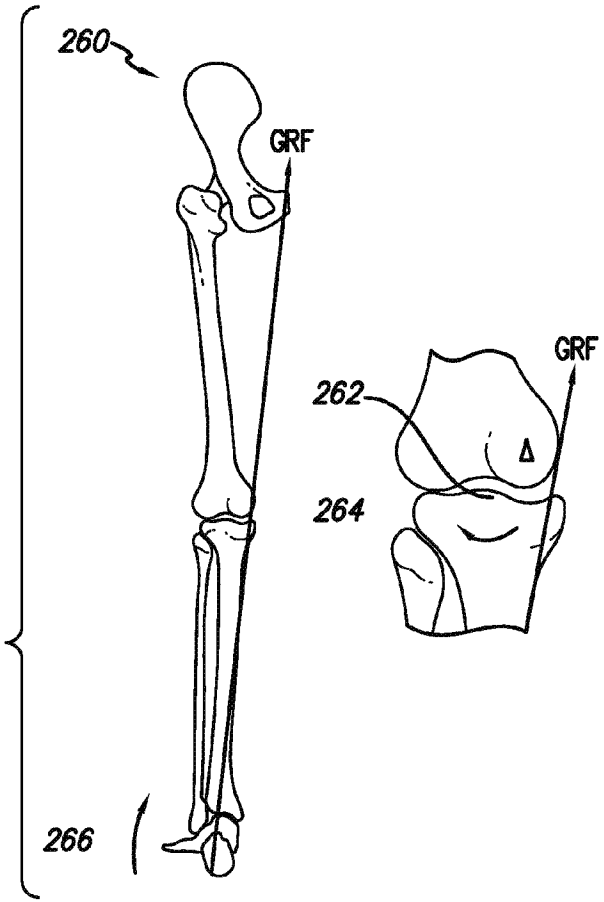
FIGS. 2*a* and 2*b* show illustrations comparing the ground reaction force (GRF) vectors for a leg in varus alignment with a rigid shoe, as shown in FIG. 2*a*, and a leg with a bare foot, as shown in FIG. 2*b;*
Figure 2A:
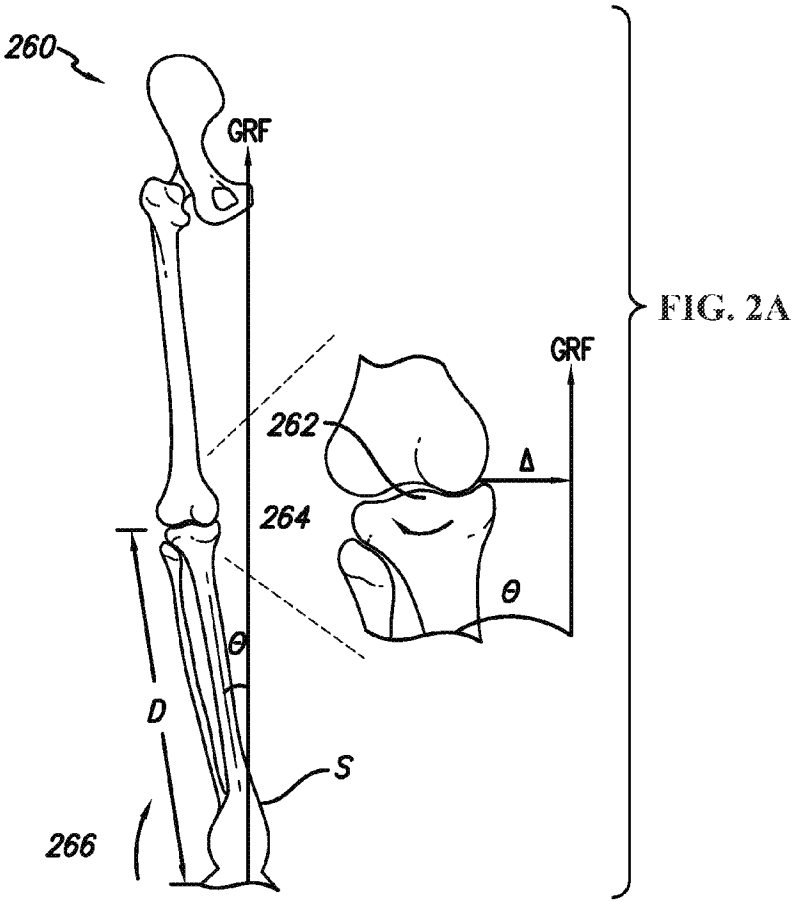

FIG. 2*a* shows an illustration of a human leg 260 in varus alignment with a common walking shoe S known in the art that restricts motion with medial reinforced components. The ground reaction force (GRF) vector is at an angle $\theta$ from the leg and located at a distance d from the center of rotation of the knee 262. The proximal end of the GRF vector is at a distance $\Delta$ from the center of rotation 262, resulting in a knee adduction moment 264. This also applies a greater moment around the hip joint axis (not shown), and to a lesser degree at the ankle/subtalar joint axis 266. FIG. 2*b* shows an illustration of a human leg 260 without a shoe in a barefoot configuration. The offset distance $\Delta$ is smaller than in FIG. 2*a*. The result at the knee is larger moments with rigid shoe S that would cause larger compressive loads at the medial knee.

Figure 3B:
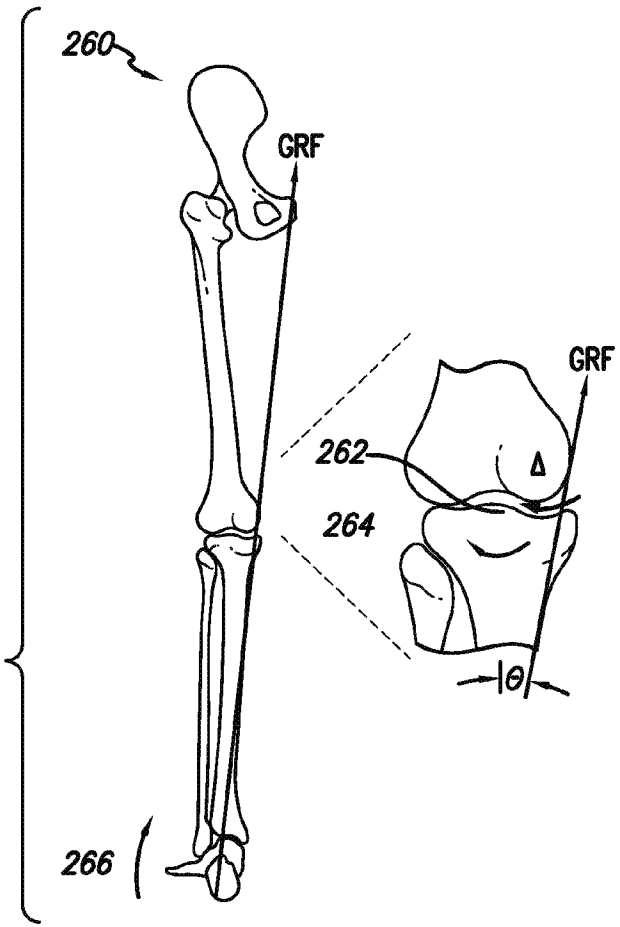
FIGS. 3*a* and 3*b* show illustrations comparing the ground reaction force (GRF) vectors for a leg in varus alignment with a shoe of the present disclosure, as shown in FIG. 3*a*, and a leg with a bare foot, as shown in FIG. 3*b;*
Figure 3A:
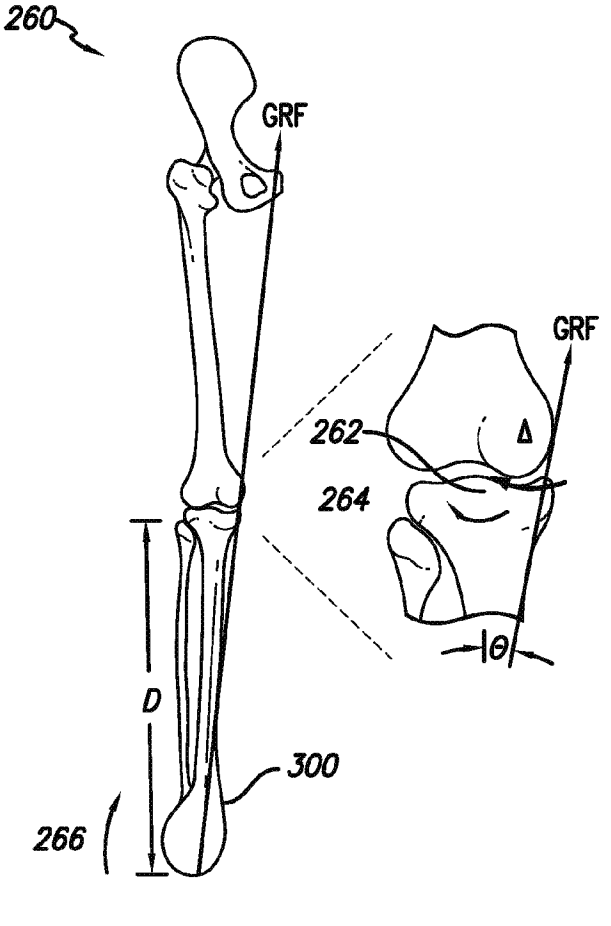

FIG. 3*a* shows an illustration of a human leg 260 in varus alignment with an embodiment of a shoe 300 of the present disclosure. The ground reaction force (GRF) vector is at an angle $\theta$ from the leg and located at a distance d from the center of rotation of the knee 262. The proximal end of the GRF vector is at a distance $\Delta$ from the center of rotation 262, resulting in a knee adduction moment 264. FIG. 3*b* shows an illustration of a human leg 260 without a shoe in a barefoot configuration, similar to FIG. 2*b* discussed previously. The barefoot configuration, without restriction, allows the foot segments to move in response to the ground reactive force thereby allowing motion and minimizing knee adduction moment 264. As can be seen, the shoe 300 of the present disclosure approximates the location of the ground reaction force (GRF) vector of the natural bare foot.

Figure 4:
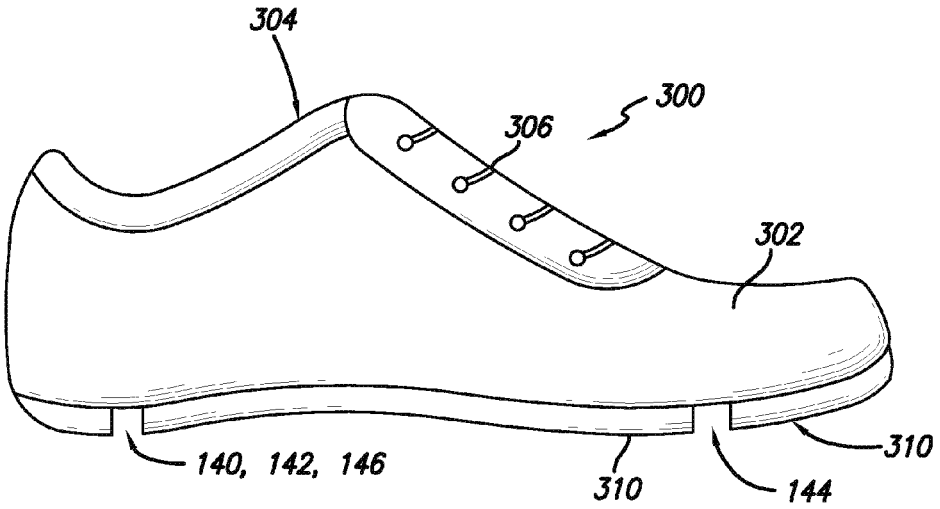
FIG. 4 shows a shoe having a flexible sole of the present disclosure.
Figure 5:
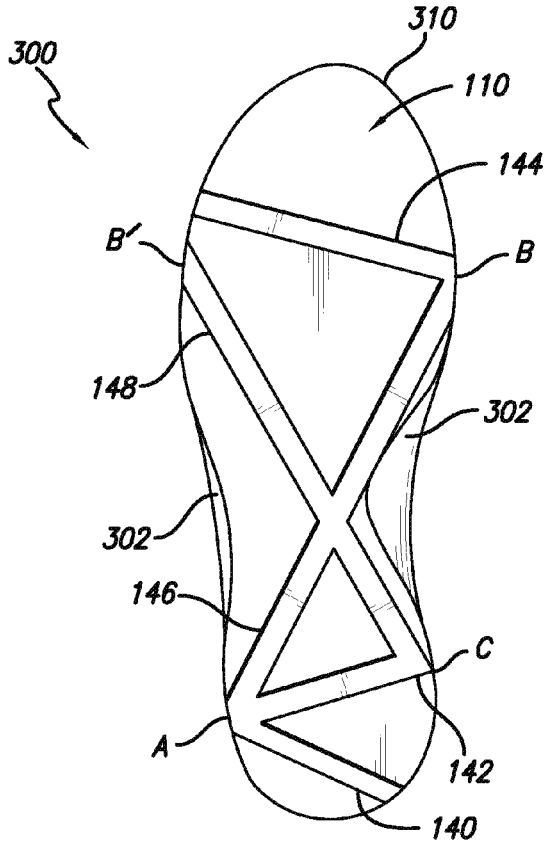
FIG. 5 is a bottom view of the shoe of FIG. 4 showing the sole with a groove pattern corresponding to primary joint axes of the human foot to approximate the characteristics of a bare foot.

Referring to FIGS. 4 and 5, an embodiment of the present disclosure includes a shoe 300 having a sole 110 as described above. As shown in FIG. 4, the shoe 300 has a lightweight flexible upper 302 configured to surround a human foot. The upper 302 may be constructed of any material that can provide flexibility without interfering with the natural movement of the foot, such as nylon, cotton fabric, canvas, or leather. The upper 302 includes an opening 304 configured for insertion of a human foot. The opening 304 may be secured about the foot by fasteners 306 such as laces, hook-and-loop fasteners such as VELCRO®, buttons, snaps, or other fastening means known in the art.

Sole 110 is attached to upper 302 and may include an outer sole 310 a mid-sole (not shown), and an inner sole (not shown). Outer sole 310 may include a plurality of traction members such as knobs or treads (not shown) to reduce slipping between the outsole 310 and a walking surface such as a floor or ground. Referring to FIG. 5, the sole 110 has a plurality of flexure zone 140, 142, 144, 146, and 148 that allow the sole 110 to flex more like the natural foot in barefoot walking.

EXAMPLES

As examples, data was collected during separate studies. Example 1, compares joint loading, in particular the external knee adduction moment, in subjects with symptomatic OA of the knee while walking with the subjects' own walking shoes and walking barefoot. Example 2, compares joint loading in healthy subjects and subjects having knee OA while walking in the subjects' own walking shoes and while walking in a shoe having a sole of the present disclosure. The third study, described in Example 3 blow, compared joint loading in subjects having knee OA while walking in footwear of the present disclosure, while walking barefoot, and while wearing common walking shoes. The fourth study, described in Example 4, tracked subjects having knee OA and who wore footwear of the present disclosure for 24 weeks. During the study, subjects were tested in their own usual walking shoes, in footwear of the present disclosure ("mobility shoes"), and walking barefoot at 0 weeks (baseline), 6 weeks, 12 weeks, and 24 weeks.

Example 1

Walking Shoes Vs. Barefoot Walking

In the first analysis, subjects were participants in an ongoing double-blind randomized controlled trial of the efficacy of lateral wedge orthotics for the treatment of knee OA [NLM Identifier: NCT00078453, at www.clinicaltrials.gov]. Inclusion criteria included the presence of symptomatic OA of the knee, which was defined by the American College of Rheumatology's Clinical Criteria for Classification and Reporting of OA of the knee and by the presence of at least 20 mm of pain (on a 100 mm visual analog scale) while walking (corresponding to question 1 of the visual analog format of the knee-directed Western Ontario and McMaster Universities Arthritis Index (WOMAC). Although all subjects had bilateral knee OA, the most symptomatic knee on the day of the initial study visit was considered the "index" knee. Subjects had OA of the index knee documented by weight-bearing full extension anterior posterior knee radiographs, of grade 2 or 3 as defined by the modified Kellgren-Lawrence (KL) grading scale. The contralateral knee also had radiographic OA of KL grade 1 to 3 in severity. Subjects had medial compartment OA defied as medial joint space narrowing (JSN) of greater than or equal to 1 as well as medial JSN greater than lateral JSN by greater than or equal to 1 grade (according to the Atlas of Altman et al., Diagnostic and Therapeutic Criteria Committee of the American Rheumatism Association, Arthritis Rheum 1986; 29(8): 1039-1049).

Major exclusion criteria were: flexion contracture of greater than 15 degrees at either knee; clinical OA of either ankle or the hip; significant intrinsic foot disease per a podiatric exam; and a body mass index (BMI) greater than 35.

All subjects underwent baseline gait analysis (before the use of orthotics). Motion during gait was measured with a multi-camera optoelectronic system (Qualysis AB Gothenburg, Sweeden) and force with a multi-component force plate (Bertec, Columbus, Ohio)(10). The walking surface consisted of 2-inch thick wooden pressboard covered with linoleum. Reflective markers were placed on the lower extremity including the iliac crest, greater trochanter, lateral joint line of the knee, laternal malleolus, calcaneus, and base of the fifth metatarsal, and joint centers were estimated on the basis of measurements of each subject. Subjects were instructed to walk at a range of speeds from slow to fast and data from 6 stride lengths on each side were collected.

These position and force data were then utilized to assess range of motion at the joints and to calculate three-dimensional external moments using inverse dynamics. The external moments that act on a joint during gait are, according to Newton's second law of motion, equal and opposite to the net internal moments produced primarily by the muscles, soft tissues, and joint contact forces. The external moments are normalized to the subjects body weight (BW) multiplied by height (Ht) times 100 (% BW*Ht) to allow for comparisons between subjects.

All subjects were asked to wear their own comfortable "walking shoes." Subjects had gait analyses performed wearing shoes. The shoes were then removed. Subjects walked for several minutes on the gait analysis platform while barefoot. After the subjects felt comfortable, gait analyses were repeated barefoot. Subjects were instructed to walk at their "normal" walking speed for the barefoot analyses. "With shoe" and "barefoot" runs were chosen for comparison from the "index" knee limb and similarly from the "contralateral" limb. "Normal" speed barefoot runs were matched for speed with "normal" speed footwear runs for analysis.

Statistical analyses were performed using SPSS software. Paired samples t-test was used to compare moments and gait parameters between footwear and barefoot walking. Relationships between differences in gait parameters and differences in joint moments during footwear and barefoot walking were evaluated using linear regression. A significance level of $<0.05$ was established a priori.

Seventy-five subjects underwent gait analyses while walking barefoot and with shoes. Of these, 40 subjects also had gait data (with and without shoes) available for the contralateral knee.

Walking speed did not change between "with shoe" and "barefoot" trials. Increased speed can increase loads during gait at the joints. Stride length was significantly decreased during barefoot walking. Meanwhile, cadence significantly increased, suggesting that although subjects were taking shorter steps, they were taking more steps per unit time. Range of motion at the major lower extremity joints as well as the toe-out angle were significantly reduced during barefoot walking.

Barefoot walking significantly decreased dynamic loads at the knees. There was an 11.9% reduction in the peak external knee adduction moment while walking barefoot compared to with shoes ($p<0.001$). There was also a significant decrease in the peak knee extension moment ($p=0.006$), while the peak knee flexion moment did not significantly change ($p=0.435$) between "with shoe" and "barefoot" trials.

Similar reductions in dynamic loads were observed at the hips during barefoot walking. The peak hip adduction moment decreased by 4.3% ($p=0.001$). The peak hip internal and external rotation moments decreased by 11.2% and 10.2% respectively ($p=0.001$).

Evaluation of gait parameters and peak moments among the contralateral knees yielded comparable results. There were notable reductions in stride length, increase in cadence, and reductions in hip, knee and ankle range of motion during barefoot walking ($p<0.05$) There were also significant reductions in peak external knee adduction moment, knee extension, hip internal rotation, and hip external rotation moments during barefoot walking ($p<0.05$). The only differences in the results at the contralateral knee were that the toe-out angle and hip AddM did not significantly change.

To assess whether the reduced loading at the knees and hips while barefoot could be explained by gait alterations alone, step-wise linear regression was used to evaluate the influence of the change in cadence, stride, toe-out angle, and hip, knee and ankle range of motion (independent variables) on the reduction in peak joint moments during barefoot walking (dependent variables). There were no significant relationships noted among any of these variables singly or collectively. This was further confirmed using backwards linear regression, in which all the independent variables were eliminated as having a significant influence on the change in peak moments. Therefore, although the character of the gait was somewhat altered, none of these measurable aspects of gait could explain the significant reductions in peak joint moments during "barefoot" trials.

Excessive loading of the lower extremities is associated with the onset and progression of knee OA. However, there has not been previous attention to the effects that common shoes may play in potentiating these aberrant loads. Differences in gait and in joint loads that occur when patients with knee OA walk barefoot compared to when they walk with shoes are disclosed. Such patients undergo a significant reduction in their joint loads at both the knees and the hips while walking barefoot compared to when walking with their normal shoes. Moreover, whereas significant changes in several gait parameters were observed during barefoot walking, including changes in stride, cadence, joint range of motion and toe-out angle, these changes in gait could not explain the significant reduction in loads at the joints. The design of common footwear may intrinsically predispose such patients to excessive loadings of their lower extremities.

Walking speed has been shown to affect loads at joints. Subjects disclosed herein had equal speeds during both "with shoe" and "barefoot" trials. There may be several differences between "with shoe" and "barefoot" walking that could account for the noted differences. For example, heels on shoes can increase peak knee torques. Most common walking shoes have a partial lift at the heel; thus, the complete lack of a "heel" during barefoot walking may be effective at reducing peak torques at the knee. Another factor is the "stiffness" imposed by the sole of most shoes. Another explanation for the biomechanical advantages of barefoot walking may be attributed to increased proprioceptive input from skin contact with the ground compared to an insulated foot contacting the ground.

Example 2

Footwear of the Present Disclosure Vs. Common Walking Shoes

A gait analysis was performed on fourteen test subjects having knee OA. The analysis consisted of measuring the loading of moments or torques on the knee joints, and in particular, the external knee adduction moment. A higher external knee adduction moment correlates with greater OA severity and greater progression of OA over time. In general, higher moments represent higher loads. Subjects were evaluated for gait while wearing their self-selected "usual" walking shoes and then while wearing footwear of the present disclosure. In each case, subjects were permitted to acclimate to the new condition prior to gait testing. Subjects walked at their normal walking speed, and comparisons were performed on runs matched for speed. The peak external knee adduction moment (% body weight*height) was calculated at the knee and used as the primary endpoint. Paired t-tests were used to compare differences in the moments during the different "footwear" conditions. There were no significant differences in speed during the walking conditions. Overall, a significant reduction in the peak external knee adduction moment was noted while walking with footwear of the present disclosure compared to "usual" walking shoes (2.6±0.6 vs. 2.9±0.6, p=0.006). These results correspond to a 10% reduction in the peak external knee adduction moment with the "unloading" shoe. An analysis of the data, summarized below in Tables 1-3, indicates a 10 percent decrease in the knee loading while walking in a shoe having a sole in accordance with the present disclosure over the test subjects' ordinary walking shoes. Also observed was a 7 percent reduction in hip loading.

Further study confirmed that the footwear of the present disclosure reduced dynamic knee loads during gait. Thirty-one subjects with radiographic and symptomatic knee OA underwent gait analyses using an optoelectronic camera system and multi-component force plate. Subjects were evaluated for gait while 1) wearing footwear of the present disclosure, and 2) wearing their self-chosen walking shoes. Subjects walked at their normal walking speed, and comparisons were performed on runs matched for speed. The primary endpoints for the study were gait parameters that reflected the extent of medial compartment knee loading and included the peak external knee adduction moment (PAddM) and the adduction angular impulse (AddImp). The PAddM is the external adduction moment of greatest magnitude during the stance phase of the gait cycle. The AddImp is the integral of the knee adduction moment over time and has recently been shown to be more sensitive than the PAddM in predicting the radiographic severity of medial compartment knee OA. There were no significant differences in speed during the walking conditions (1.16±0.23 vs. 1.15±0.25 m/sec, p=0.842). There was an 8% reduction in the PAddM (2.73±0.76 vs. 2.51±0.80% BW*ht, p<0.001) and a 7% reduction in the AddImp (0.96±0.45 vs. 0.89±0.45% BW*ht, p<0.016) with the footwear of the present disclosure compared to subjects' self-chosen walking shoes.

Yet a further analysis concludes that footwear of the present disclosure reduces joint loading in healthy individuals without OA. Twenty-six normal subjects underwent gait analyses of their dominant limb using an optoelectronic camera system and a multi-component force plate. Subjects were evaluated for gait while wearing their self-selected "usual" walking shoes. In addition, all of the subjects underwent gait analyses while barefoot and 19 underwent analyses wearing footwear of the present disclosure. In each case, subjects were permitted to acclimate to the new condition prior to gait testing. Subjects walked at their normal walking speed, and comparisons were performed on runs matched for speed. The peak external knee adduction moment (% body weight*height) was calculated at the knee and used as the primary endpoint. Paired t-tests were used to compare differences in the moment during the different "footwear" conditions. There were no significant differences in speed during the three walking conditions. Overall, a significant reduction in the peak external knee adduction moment was noted during barefoot walking (2.0±0.7 vs. 2.3±0.8, p=0.023) and while walking with footwear of the present disclosure (2.0±0.9 vs. 2.3±0.8, p=0.009) compared to "usual" walking shoes. These results corresponded to a 13% reduction the peak external knee adduction moment during the barefoot and load reducing footwear conditions.

Example 3

Footwear of the Present Disclosure Vs. Common Walking Shoes Vs. Barefoot Walking Nineteen subjects were studied with radiographic and symptomatic knee OA underwent gait analyses using an optoelectronic camera system and multi-component force plate. Subjects were evaluated for gait while 1) wearing footwear of the present disclosure, 2) wearing a "control" shoe, a commonly prescribed walking shoe, engineered to provide foot stability and comfort and 3) walking barefoot. In each case, subjects were permitted to acclimate to the new condition prior to gait testing. Subjects walked at their normal walking speed, and comparisons were performed on runs matched for speed. The peak external knee adduction moment (% body weight*height) was calculated at the knee and used as the primary endpoint. There were no significant differences in speed during the walking conditions. Overall, a significant reduction in the peak external knee adduction moment was noted while walking with footwear of the present disclosure compared to the "control" walking shoes (2.6±0.7 vs. 3.1±0.7, p<0.001). These results correspond to a 16% reduction in the peak external knee adduction moment. There was no significant difference in peak knee adduction moment between the footwear of the present disclosure and barefoot walking (2.6±0.7 vs. 2.7±0.7, p=0.386).

Therefore, it is advantageous to incorporate the teachings of the present disclosure into footwear to effectively reduce dynamic knee loads during gait.

TABLE 1

Paired Samples Statistics

| | | Mean | N | Std. Deviation | Std. Error Mean |
|---|---|---|---|---|---|
| Pair 1 | KMYADD | 2.90064 | 14 | 0.594602 | 0.158914 |
| | sKMYADD | 2.62421 | 14 | 0.581111 | 0.155308 |
| Pair 2 | KMYADD | 3.88514 | 14 | 0.968716 | 0.258900 |
| | sKMYADD | 3.62357 | 14 | 0.824524 | 0.220363 |
| Pair 3 | KMYADD | 0.60607 | 14 | 0.236105 | 0.063102 |
| | sKMYADD | 0.53986 | 14 | 0.228314 | 0.061019 |

TABLE 2

| Paired Sample Correlations | | N | Correlation | Sig. |
|---|---|---|---|---|
| Pair 1 | KMYADD & sKMYADD | 14 | 0.856 | 0.000 |
| Pair 2 | HMYADD & sHMYADD | 14 | 0.921 | 0.000 |
| Pair 3 | HMZEXT & sHMZEXT | 14 | 0.865 | 0.000 |

TABLE 3

| Paired Sample Differences | | Paired Differences | | | | | | | |
|---|---|---|---|---|---|---|---|---|---|
| | | | Std. | Std. Error | 95% Confidence Interval of the Difference | | | | Sig. |
| | | Mean | Deviation | Mean | Lower | Upper | t | df | (2-tailed) |
| Pair 1 | KMYADD & sKMYADD | 0.276429 | 0.316157 | 0.084497 | 0.093885 | 0.458972 | 3.271 | 13 | 0.006 |
| Pair 2 | HMYADD & sHMYADD | 0.261571 | 0.384422 | 0.102741 | 0.039613 | 0.483530 | 2.546 | 13 | 0.024 |
| Pair 3 | HMZEXT & sHMZEXT | 0.066214 | 0.120986 | 0.032335 | −0.003641 | 0.136070 | 2.048 | 13 | 0.061 |

Wherein:

KMYADD is the peak knee adduction moment when subjects walking with their own walking shoes (the variable that has been correlated with knee arthritis- both severity and progression);

sKMYADD is the peak knee adduction moment while wearing footwear of the present disclosure;

HMYADD is the peak hip adduction moment;

sHMYADD is the peak hip adduction moment while wearing footwear of the present disclosure;

HMZEXT is the peak hip external rotation moment; and sHMZEXT is the peak hip external rotation moment while wearing footwear of the present disclosure.

Additional data was also collected during the studies for the following parameters:

speed: msec
stride: length of step (meters/height)
cadence: steps/minute
kmyadd: peak knee adduction moment (% BW*ht)
hrom: hip range of motion (degrees)
arom: ankle range of motion (degrees)
krom: knee range of motion (degrees)
hmxflex: peak hip flexion moment (% BW*ht)
hmxext: peak hip extension moment (% BW*ht)
kmxflex: peak knee flexion moment (% BW*ht)
kmxext: peak knee extension moment (% BW*ht)
hmyadd: peak hip adduction moment (% BW*ht)
hmyabd: peak hip abduction moment (% BW*ht)
kmyabd: peak knee abduction moment (% BW*ht)
hmzint: peak hip internal rotation moment (% BW*ht)
hmzext: peak hip external rotation moment (% BW*ht)

Example 4

Extended Use of the Footwear of the Present Disclosure/Mobility Shoes

Sixteen subjects with medial compartment OA were recruited for an extended study utilizing the footwear of the present disclosure to attempt to prove that the footwear of the present disclosure ("mobility shoes") yield sustained reductions in loading of the medial compartment of the knee after extended use, in particular, use after 6 months. The mean age of the subjects was 59 years of age (+/−9 years), 9 subjects were male and 4 were female, and 10 subjects had a KL grade of 2, while 6 subjects had a KL grade of 3. The subjects each had a WOMAC visual analog scale ("VAS") of greater or equal to 30 mm while walking. The study excluded subjects with significant foot pathology and VAS pain at the hip or ankle greater than or equal to 20 mm. Three subjects terminated the study early (one after 6 weeks, one after 8 weeks, and one after 12 weeks).

During an initial screening visit (at 0 weeks) ("baseline visit"), all subjects underwent baseline gait analysis (before the use of the footwear of the present disclosure). Motion during gait was measured with a multi-camera optoelectronic system (Qualysis AB Gothenburg, Sweden) and force with a multi-compartment force plate (Bertec, Columbus, Ohio) (10). The walking surface consisted of 2-inch thick wooden pressboard covered with linoleum. Reflective markers were placed on the lower extremity including the iliac crest, greater trochanter, lateral joint line of the knee, laternal mallelus, calcaneus, and base of the fifth metatarsal, and joint centers were estimated on the basis of measurements of each subject. Subjects were instructed to walk at a range of speeds from slow to fast and data from 6 stride lengths on each side were collected.

Figure 7:
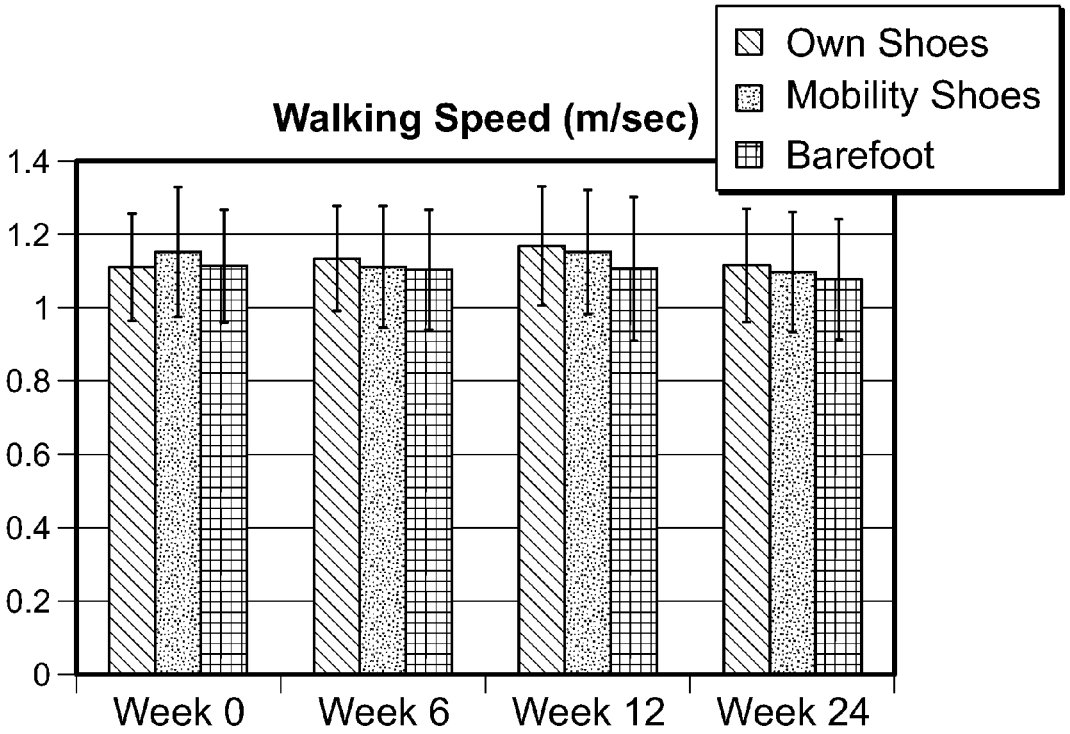
FIG. 7 is a graph depicting mean (and the full range of) walking speeds (m/sec) at 0 weeks, 6 weeks, 12 weeks, and 24 weeks using one's own usual walking shoes, the footwear of the present disclosure, and barefoot.

The gait analysis consisted of measuring the loading moments or torques on the knee joints, in particular, the external knee adduction moment. A higher external knee adduction moment correlates with greater OA severity and greater progression of OA over time. In general, higher moments represent higher loads. Subjects were evaluated for gait while wearing their self-selected "usual" walking shoes, while walking barefoot, and while wearing mobility shoes ("the footwear conditions"). In each case, subjects were permitted to acclimate to the new condition prior to gait testing. Subjects walked at their normal walking speed, and comparisons were performed on runs matched for speed. The overall walking speeds for the three footwear conditions did not vary dramatically, no matter when the analysis was performed, as can be seen in FIG. 7.

During the baseline visit, a WOMAC VAS pain evaluation was also conducted for each subject. At that time, the mobility shoes and a diary were provided to each subject. Each subject was asked to wear the mobility shoes for at least 6 hours per day for at least 6 days out of each week. The subjects were also asked to document in the diary how long they wore the shoes each day and whether they had any problems and what those problems were.

The primary endpoints for the study were gait parameters that reflected the extent of medial compartment knee loading and included the peak external knee adduction moment (PAddM) and the adduction angular impulse (AddImp). During the study, all patients returned for testing at 6 weeks, 12 weeks, and 24 weeks to undergo the same WOMAC VAS pain evaluation and gait analysis.

Figure 6:
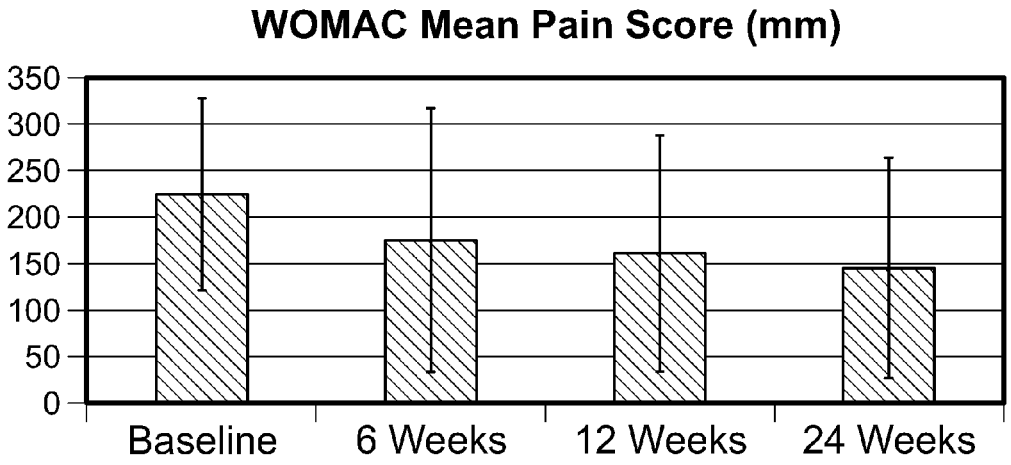
FIG. 6 is a graph depicting mean (and the full range of) WOMAC pain scores (mm) at 0 weeks, 6 weeks, 12 weeks, and 24 weeks.

Referring to FIG. 6, the study showed a mean WOMAC pain score (in mm) reduction of about 36% between the first analysis at 0 weeks and the final analysis at 24 weeks. The data detailing the WOMAC pain scores is detailed in Table 4.

TABLE 4

| WOMAC Pain Score | Mean | Std. Deviation | N |
|---|---|---|---|
| WOMAC pain score at affected knee week 0 (0-500) | 225.0556 | 102.52975 | 18 |
| WOMAC pain score at affected knee week 6 (0-500) | 175.3333 | 141.54110 | 18 |
| WOMAC pain score at affected knee week 12 (0-500) | 163.0278 | 123.85137 | 18 |
| WOMAC pain score at affected knee week 24 (0-500) | 144.0833 | 117.49696 | 18 |

Figure 8:
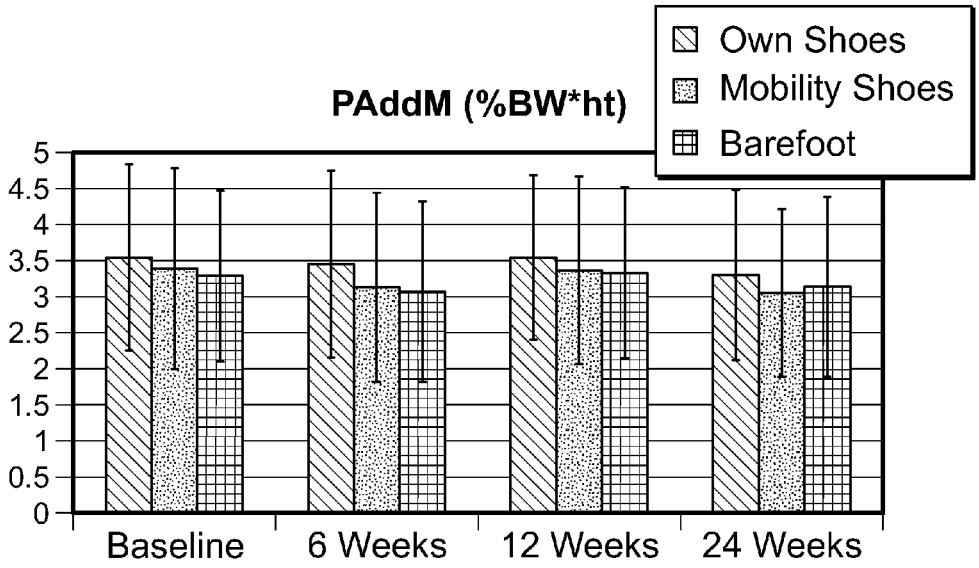
FIGS. 8 and 10 are graphs depicting a mean (and the full range of in FIG. 8) peak external knee adduction moment (PAddM) at 0 weeks, 6 weeks, 12 weeks, and 24 weeks using one's own usual walking shoes, the footwear of the present disclosure, and barefoot.
Figure 9:
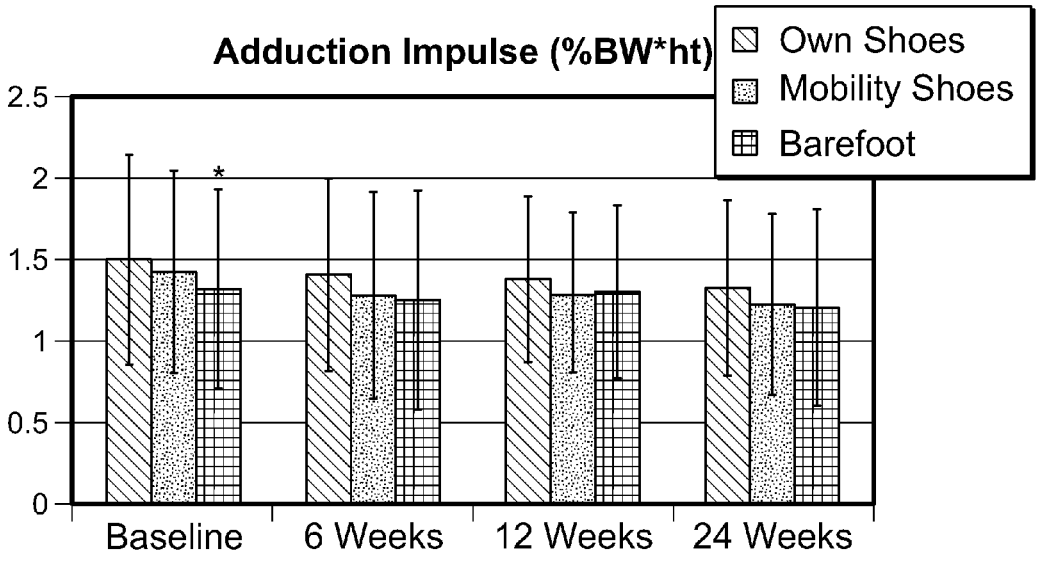
FIGS. 9 and 11 are graphs depicting a mean (and the full range of in FIG. 9) adduction angular impulse (AddImp) at 0 weeks, 6 weeks, 12 weeks, and 24 weeks using one's own usual walking shoes, the footwear of the present disclosure, and barefoot.
Figure 10:
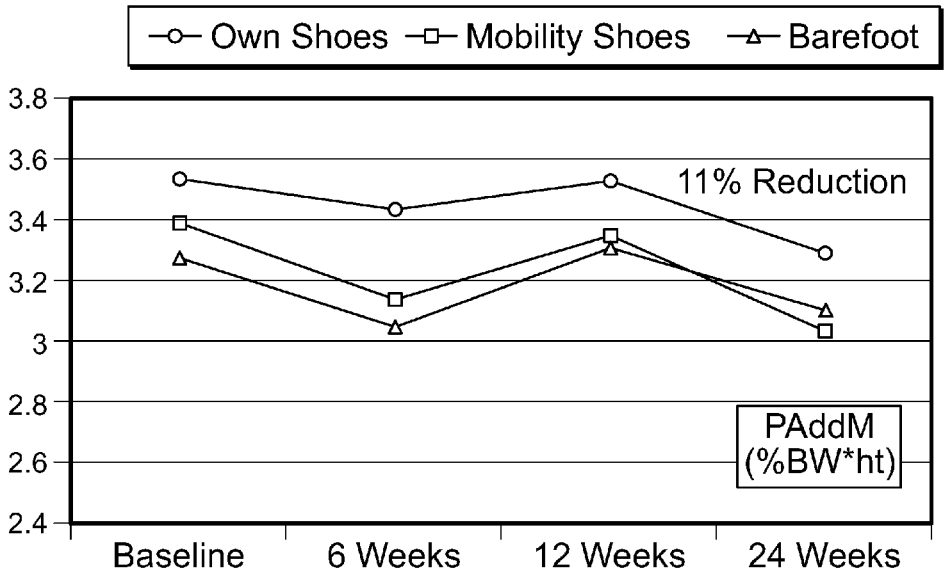
Figure 11:
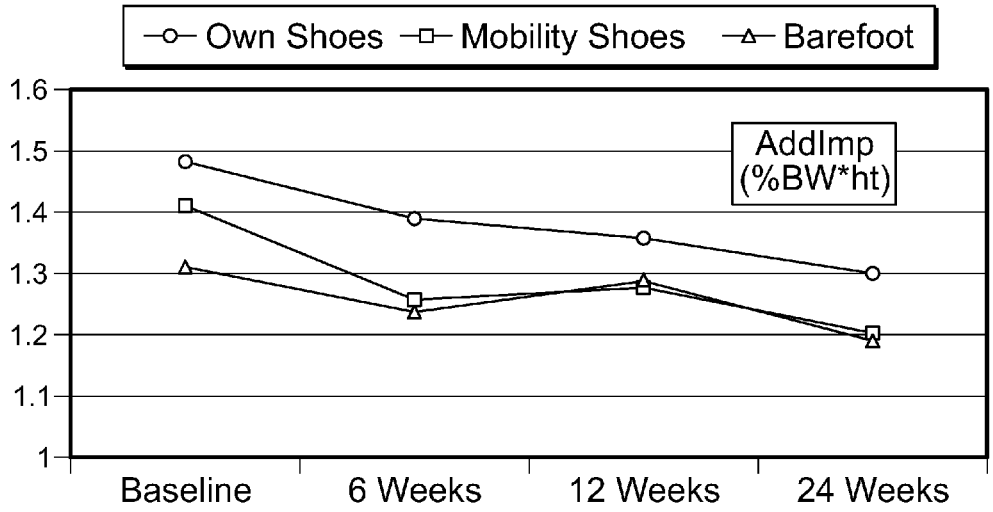

Further, referring to FIGS. 8 and 10, the study showed from the gait analysis that, over the 6 month period, there was an overall reduction of about 17% of the mean peak adduction moment between 0 weeks and 24 weeks with the mobility shoes and no significant difference in the mean peak adduction moment when utilizing the mobility shoes versus walking barefoot. As can be seen from FIGS. 9 and 11, the study also indicated that there was a reduction in the mean adduction impulse of about 19% with the mobility shoes between the first gait analysis at 0 weeks and the final gait analysis at 24 weeks. Again, at 24 weeks, there was no significant difference in the mean adduction impulse when using the mobility shoes versus walking barefoot. Overall, these results indicate that, significant use of the mobility shoes, which mimic barefoot walking, reduces overall loads over time. In addition, as can be seen in FIGS. 8-11, the mean peak adduction moment and the mean adduction impulse decreased between 0 and 24 weeks when the subjects utilized their usual walking shoes, thereby indicating that the mobility shoes have taught the subjects to walk in a certain manner that is carried over to use of their usual walking shoes. The data detailing the knee adduction moments of FIGS. 8 and 10 is shown in Table 5 below and the data detailing the adduction impulse moment of FIGS. 9 and 11 is shown in Table 6 below.

TABLE 5

| Knee Adduction Moment | Mean | Std. Deviation | N |
|---|---|---|---|
| Maximum knee adduction moment about Y-axis in frontal plane week 0 Own Shoes | 3.52106 | 1.345972 | 16 |
| Maximum knee adduction moment about Y-axis in frontal plane week 6 Own Shoes | 3.40769 | 1.182742 | 16 |
| Maximum knee adduction moment about Y-axis in frontal plane week 12 Own Shoes | 3.44269 | 1.132581 | 16 |
| Maximum knee adduction moment about Y-axis in frontal plane week 24 Own Shoes | 3.11631 | 1.102479 | 16 |

TABLE 5-continued

| Knee Adduction Moment | Mean | Std. Deviation | N |
|---|---|---|---|
| Maximum knee adduction moment about Y-axis in frontal plane week 0 Barefoot | 3.24175 | 1.237029 | 16 |
| Maximum knee adduction moment about Y-axis in frontal plane week 6 Barefoot | 3.00231 | 1.168920 | 16 |
| Maximum knee adduction moment about Y-axis in frontal plane week 12 Barefoot | 3.21244 | 1.187820 | 16 |
| Maximum knee adduction moment about Y-axis in frontal plane week 24 Barefoot | 2.91781 | 1.197238 | 16 |
| Maximum knee adduction moment about Y-axis in frontal plane week 0 Modified Shoe | 3.39475 | 1.445501 | 16 |
| Maximum knee adduction moment about Y-axis in frontal plane week 6 Modified Shoe | 3.08794 | 1.240188 | 16 |
| Maximum knee adduction moment about Y-axis in frontal plane week 12 Modified Shoe | 3.24006 | 1.294624 | 16 |
| Maximum knee adduction moment about Y-axis in frontal plane week 24 Modified Shoe | 2.88744 | 1.106718 | 16 |

TABLE 6

| Impulse Moment | Mean | Std. Deviation | N |
|---|---|---|---|
| Impulse Moment week 0 Own Shoes | −1.450844 | .6376544 | 16 |
| Impulse Moment week 6 Own Shoes | −1.381563 | .5751461 | 16 |
| Impulse moment week 12 Own shoes | −1.346194 | .4859922 | 16 |
| Impulse moment week 24 Own Shoes | −1.262375 | .5227333 | 16 |
| Impulse Moment Barefoot week 0 | −1.300675 | .5761559 | 16 |
| Impulse Moment week 6 Barefoot | −1.231425 | .6342875 | 16 |
| Impulse Moment Week 12 Barefoot | −1.275506 | .5040247 | 16 |
| Impulse moment week 24 Barefoot | −1.170013 | .5609134 | 16 |
| Impulse Moment week 0 Modified Shoes | −1.376531 | .6062613 | 16 |
| Impulse Moment week 6 Modified Shoes | −1.240469 | .6115913 | 16 |
| Impulse Moment week 12 Modified Shoe | −1.268200 | .4749861 | 16 |
| Impulse moment week 24 Modified shoe | −1.173031 | .5355317 | 16 |

In summary, the fourth study showed that:

(1) after 6 months of use of the mobility shoe, there were significant reductions (about 36% in knee pain and knee loading in subjects with medial compartment knee OA;

(2) The mobility shoe had a significant load reducing effect by 6 weeks of use;

(3) By 24 months, significant reductions in load were shown in all subjects even once the mobility shoes were removed;

These findings suggest a possible gait adaptation, suggesting that biomechanical interventions may result in beneficial neuromuscular and behavioral changes. Part of the explanation for the gait adaptation is that the mobility shoes provide an enhanced sensory input for the subject utilizing the shoes. In particular, due to the addition of the flexure zones and decreased thickness of the sole of the shoe, a subject can better feel the movement of his/her feet and can feel the sensation of having their feet contact the ground (which is minimized with thick-soled shoes). Enhanced sensory input provides mechanical advantages for joint loading because, with the increased sensory input, the foot is better able to place itself on the ground. Sensory input is important to balance and therefore, this increased sensory input may decrease the risk of falls that are commonly related to balance.

We claim:

1. A method of reducing loads on the knee, the method comprising the steps of:

providing a shoe with a sole having a plurality of flexure zones, wherein each of the flexure zones is formed by a groove formed in the sole and which forms a straight line, each straight line extending from an inner portion to an outer portion of the sole; and positioning a first flexure zone within the sole and extending posteriorly from a first apex at a base of the heel;

positioning a second flexure zone within the sole and extending anteriorly from the first apex;

positioning a third flexure zone extending anteriorly from a second apex at a medial edge of a base of the forefoot;

positioning a fourth flexure zone within the sole and having a first end beginning at the first apex and a second end terminating at the second apex;

positioning a fifth flexure zone within the sole and extending posteriorly from the base of the forefoot;

locating the flexure zones such that the shoe simulates the motions, force applications, and proprioceptive feedback of a natural human foot, thereby reducing a load placed on the knee.

2. A method of reducing loads on the knee, the method comprising the steps of:

providing a shoe with a sole having a first flexure zone positioned within a sole of the shoe and extending posteriorly from an apex at a lateral edge of the base of the heel;

a second flexure zone positioned within the sole and extending anteriorly from the apex, the second flexure zone intersecting the first flexure zone at the apex;

a third flexure zone positioned within the sole and extending anteriorly from the base of forefoot;

a fourth flexure zone positioned within the sole and extending anteriorly from the apex, the fourth flexure zone intersecting the first flexure zone and the second flexure zone at the apex; and a fifth flexure zone positioned within the sole and extending posteriorly from the base of forefoot;

wherein the flexure zones comprise lines of reduced rigidity of the sole; and allowing the flexure zones of the shoe to simulate the motions, force applications, and proprioceptive feedback of a natural human foot, thereby reducing a load placed on the knee.

3. The method of claim 2 wherein the first flexure zone and the base of heel define a first angle of approximately 30 degrees.

4. The method of claim 2 wherein the second flexure zone and the base of the heel define a second angle of approximately 15 degrees.

5. The method of claim 2 wherein the third flexure zone and the base of the forefoot define a third angle of approximately 10 degrees.

6. The method of claim 2, wherein the fourth flexure zone extends posteriorly from the base of forefoot.

7. The method of claim 2 wherein the fourth flexure zone extends between the base of heel and the base of forefoot.

8. The method of claim 2 wherein the fifth flexure zone extends between the base of forefoot and the second flexure zone.

9. The method of claim 2 wherein the shoe further includes a plurality of traction members.

10. The method of claim 2 wherein the shoe further includes a rounded heel portion.

11. The method of claim 2, wherein the shoe includes a first material disposed between one or more of the flexure zones that is different than a second material disposed between one or more of the flexure zones.

12. A method of reducing loads on the knee, the method comprising the steps of:

providing a shoe with a sole having a first flexure zone positioned within the sole and extending from an apex at the lateral edge of the base of heel and oriented at an angle approximately 30 degrees posterior to the base of heel;

a second flexure zone positioned within the sole and extending from the apex at the lateral edge of the base of heel and oriented at an angle approximately 15 degrees anterior to the base of heel;

a third flexure zone positioned within the sole and extending from the base of forefoot and oriented at an angle approximately 10 degrees anterior to the base of forefoot;

a fourth flexure zone positioned within the sole and extending from the medial edge of the base of forefoot to the apex at the lateral edge of the base of heel; and a fifth flexure zone positioned within the sole and extending from the lateral edge of the base of forefoot to the medial edge of the second flexure zone; and wherein each of the flexure zones is formed as a groove within the sole of the shoe and forms a straight line, each straight line extending from an inner portion to an outer portion of the sole;

allowing the flexure zones of the shoe to simulate the motions, force applications, and proprioceptive feedback of a natural human foot, thereby reducing a load placed on the knee.

13. The method of claim 12, wherein the shoe further includes a plurality of traction members.

14. The method of claim 12 further including a rounded heel portion.

* * * * *